US010643586B1

(12) United States Patent
Horban et al.

(10) Patent No.: US 10,643,586 B1
(45) Date of Patent: May 5, 2020

(54) SYSTEM FOR FIXING AND TENSIONING STRINGS OF A STRINGED MUSICAL INSTRUMENT

(71) Applicant: JAMMY INSTRUMENTS LTD., Nicosia (CY)

(72) Inventors: Mykhailo Horban, Kharkov (UA); Dmytro Doroshenko, Kyiv (UA); Volodymyr Shelest, Kyiv (UA)

(73) Assignee: JAMMY INSTRUMENTS LTD., Nicosia (CY)

( * ) Notice: Subject to any disclaimer, the term of this patent is extended or adjusted under 35 U.S.C. 154(b) by 0 days.

(21) Appl. No.: 16/542,771

(22) Filed: Aug. 16, 2019

(30) Foreign Application Priority Data

Apr. 18, 2019 (UA) ..... 201904094

(51) Int. Cl.
*G10D 3/14* (2020.01)
*G10D 3/12* (2020.01)

(52) U.S. Cl.
CPC ..... *G10D 3/143* (2013.01); *G10D 3/12* (2013.01)

(58) Field of Classification Search
CPC ..... G10H 1/346; G10H 2220/221; G10H 2220/285; G10H 1/344; G10H 1/34; G10C 3/12; G10B 3/12
See application file for complete search history.

(56) References Cited

U.S. PATENT DOCUMENTS 9,564,110 B2 2/2017 Steinberger
2003/0019349 A1* 1/2003 Green ..... G10D 1/085 84/731
2006/0162528 A1* 7/2006 Kinoshita ..... G10D 3/04 84/298

FOREIGN PATENT DOCUMENTS

RU 2 408 086 C1 12/2010
WO WO-2005/114647 A1 12/2005

* cited by examiner

*Primary Examiner* — Kimberly R Lockett
(74) *Attorney, Agent, or Firm* — Saliwanchik, Lloyd & Eisenschenk

(57) ABSTRACT

A system for fixing and tensioning strings of a stringed musical instrument comprises a string holder provided on one end of a neck, an upper nut provided on a second end of the neck and adjusting screw mechanisms in an amount that corresponds to the amount of strings, while each of the strings is configured so that its first end can be fixed in the string holder, the second end can be passed through grooves of the upper nut and fixed on the adjusting screw mechanism. An arrangement for directing the strings is mounted after the upper nut on a face surface of the neck, in a form of a curved plate, which has guides for the strings provided therein. The adjusting screw mechanisms are arranged at an acute angle relative to the longitudinal axis of the neck in a frame fixed on a back surface of the neck. A neck reinforcement member can be mounted in a central portion of the neck along the entire length.

7 Claims, 6 Drawing Sheets

SYSTEM FOR FIXING AND TENSIONING STRINGS OF A STRINGED MUSICAL INSTRUMENT

CROSS-REFERENCE TO RELATED APPLICATION

This application claims priority to Ukrainian Application No. a201904094, filed Apr. 18, 2019; which is hereby incorporated by reference in its entirety.

FIELD OF THE INVENTION

The invention relates to the field of musical industry and concerns a system for fixing and tensioning strings to be used in stringed musical instruments, which comprise a neck, such as a guitar, a violin, a dombra, etc.

BACKGROUND OF THE INVENTION

A traditional system for fixing and tuning strings is made by peg mechanisms arranged on a head on the neck end, to which a free end of each string is bounded, and a support fixed on the housing of the instrument, wherein other ends of the strings are fixed. Said system for fixing is rather bulky and is not always suitable for modern musical instruments, among which there are electronic instruments, which do not require a housing for resonance sound excitation to be present.

A system for fixing and tuning strings of an electric guitar is known, the system consisting of a clamp for free ends of the strings that is mounted on a face of the neck such that a string that passes through the clamp bends at an angle of 90° on the face of the neck at a right angle to the neck plane, and a machine for tensioning and tuning the strings that is mounted on the housing of the instrument behind a lower nut. The machine for tensioning and tuning the strings has an ease and simplified structure. Tensioning of the strings is performed by means of screws, which pull brackets with the strings extended therethrough to a rear wall of the machine (patent RU2408086 C2 of Dec. 27, 2010). A drawback of said system lies in that if in case of need in replacing one string, it will be required to dismount the entire system for tensioning the strings from the neck.

Also, a device for adjusting a tension of strings is known, the device having at least two strings, each string from one end is bound on a turn knob of an adjusting mechanism mounted on a neck of an instrument. The adjusting mechanism comprises a combination that consists of a worm shaft and a worm wheel. A drive element for each adjusting mechanism is mounted on the neck of the instrument. A drive assembly is directly coupled to the worm shaft or with the worm wheel of this adjusting mechanism in order to drive the worm shaft or the worm wheel (application WO2005114647 A1 of Dec. 1, 2005).

Drawbacks of the known analogues lie in large overall sizes due to arrangement of the adjusting mechanism on a purpose-made neck head and inconvenience of use during tuning the instrument due to complexity of loading the string into the adjusting mechanism.

These drawbacks are partially eliminated in a system for tensioning and tuning strings for stringed instruments taken as the closest analogue of the claimed invention, a system consisting of a string holder provided on one end of a neck, an upper nut provided on a second end of the neck and adjusting screw mechanisms in an amount that corresponds to the amount of the strings, while each of the strings is configured so that its first end can be fixed in the string holder, and the second end can be passed through grooves of the upper nut and fixed on the adjusting screw mechanism, wherein tension of the string drives one or more levers in order to generate two points of a clamping force along the string (U.S. Pat. No. 9,564,110 B2 of Feb. 7, 2017). A drawback of this system lies in that it applies a complex generation of two points of the clamping force along the string, for which a lever with a screw-locked stop is used in order to increase or reduce the string tension that requires a bulky outfit of the neck and, as a consequence, large overall sizes of the system itself and complexity in a setting thereof.

SUMMARY OF THE INVENTION

The invention is based on a task to create a compact system for tensioning strings that can be arranged within sizes of a neck of a musical instrument and has a convenient system for tensioning strings and tuning the musical instrument.

The set task is solved as follows. The system for fixing and tensioning strings of a stringed musical instrument comprises of a string holder provided on one end of a neck, an upper nut provided on a second end of the neck and adjusting screw mechanisms in an amount that corresponds to the amount of strings, while each of the strings is configured so that its first end can be fixed in the string holder, the second end can be passed through grooves of the upper nut and fixed on the adjusting screw mechanism. According to the invention, an arrangement for directing the strings is mounted after the upper nut on a face surface of the neck, the arrangement is made in a form of a curved plate, which has guides for the strings provided therein. The adjusting screw mechanisms are arranged at an acute angle relative to the longitudinal axis of the neck in a direction that is opposite to the direction of directing the strings from the side of the curved plate and are arranged in a frame fixed on a back surface of the neck. Each screw mechanism is a tension screw having an arrangement for fixing a string in the form of a female screw that is immovably mounted in the frame, the female screw having a slot provided in an upper portion thereof, and a collar, which upper portion is provided with a cavity for placing the string that is coupled to the slot of the female screw, the collar is equipped, in the location of the end of the string, with a member that separates it from the screw, while the second end of each string is equipped with a tip having a width that exceeds a width of the cavity of the collar. A neck reinforcement member is mounted in a central portion of the neck along the entire length thereof.

Thus, a presence of the arrangement for directing the strings in the form of the curved plate with guides allows one to place the strings such that they do not contact each other during their tensioning and fixing. Therewith, the cavities of the guides are made flat such that enables minimal resistance and friction in the process of tensioning the strings, and may have a radius of at most 1.5-2 of a radius of the cross-section of the string, so as to avoid shifting of the strings relative to the neck axis when using the musical instrument.

Regarding arrangement of the adjusting screw mechanisms on the back surface of the neck and making them in the form of tension screws, each of them is equipped with the arrangement for fixing the strings in the form of female screw that is immovably mounted in the frame, the female screw having a slot provided in an upper portion thereof, and a collar, which upper portion is provided with a cavity for placing the string that is coupled to the slot of the female screw, which allows the reduction of the overall sizes of the neck and the increase in reliability and convenience of fixing and tensioning the strings of the musical instrument due to creation of a compact and reliable fixation element and to the fact that the adjusting screw mechanisms are separated from each other due to their geometrical position in the frame that enables one to perform the adjustment for each string individually without hindrance.

In case of using the system in electrical stringed instruments, wherein the strings act as an electrical conductor, presence of a separator between the collar and the screw provides isolation of the string from the elements of the tensioning system and the frame, as well as avoids contacting between the string and the screw mechanism.

Presence of the neck reinforcement member that is mounted in the central portion of the neck along the entire length thereof and is made of a high-tensile alloy provides not only an additional rigidity of the neck, but also a strength, and avoids deformation of the neck at any allowably possible tension of the strings and when applying forces in the process of playing the instrument. For example, manufacturing the neck of wood, and the frame and the neck reinforcement member—preferably of metal, and preferably of a high-tensile alloy of steel—allows an increase in reliability and service life of the instrument, and to reduce the weight thereof.

In one of embodiments of the system, the frame is provided with mounting seats for each adjusting screw mechanism along the axis of the neck, which are arranged symmetrically successively opposite one another. Such technical solution allows, if needed, to perform a replacement of the screw mechanism for tensioning strings in a convenient and operative way. According to a further embodiment, the frame of the system is made of metal. This allows it to withstand significant loads onto the frame, which are associated not only with tensioning of the string, but also with high loads in the process of playing the musical instrument, and to increase the reliability of use thereof that permits reduction of the size of the musical instrument.

According to a further embodiment, a truss rod is used as the neck reinforcement member in the system.

According to a further embodiment, the system is configured so that it can be closed by a cover on the face and back surfaces of the neck in order to protect the system for fixing and tensioning the strings from entry of foreign objects, mud, moisture, etc.

According to a further embodiment, the system comprises electrical contacts, which are coupled to a controller of an electrical board arranged inside the neck, mounted between the upper nut and the curved plate from the inner side of the curved plate, which allows use of the system for tensioning the strings in electrical stringed instruments, wherein the strings perform a function of an electrical conductor, the curved plate and the collar member that separate the strings from the screws are made of an electrically insulating material in order to avoid a short circuit between the strings and the screw mechanisms.

BRIEF DESCRIPTION OF THE DRAWINGS

The invention disclosed herein will be more clearly understood from the following exemplary embodiment and the corresponding accompanying drawings in which:

FIG. 1A is a top view, FIG. 1B is a bottom view, and FIG. 1C is a side view.

FIG. 2A is a general view, and FIG. 2B is a top view.

FIG. 4A is a top view, and FIG. 4B is a rear portion view.

Figure 1A:
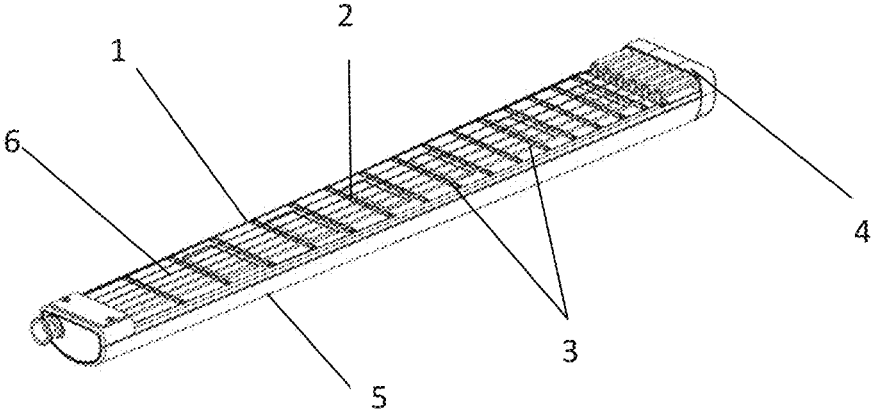
FIGS. 1A-1C are general views of the neck with the assembled system for fixing and tensioning the strings.
Figure 1B:
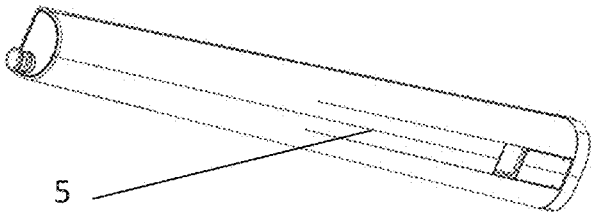
Figure 1C:
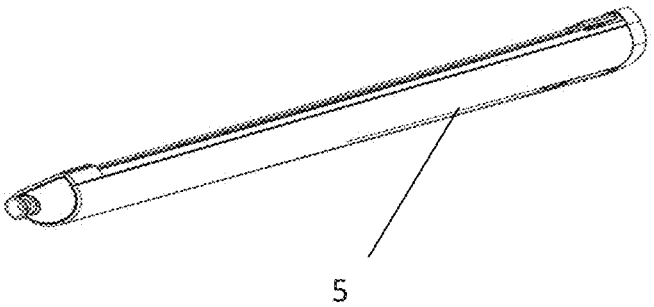
Figure 2A:
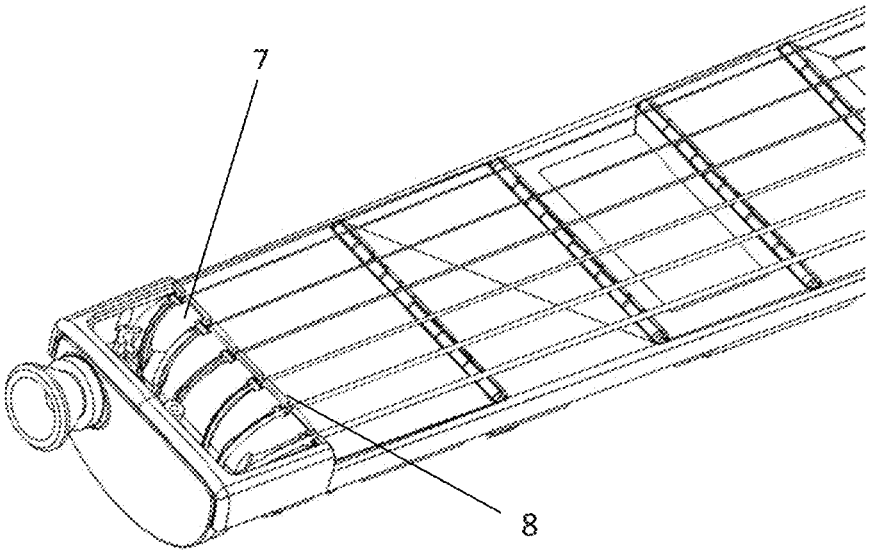
FIGS. 2A and 2B are fragments of the neck with the system for fixing and tensioning the strings.
Figure 2B:
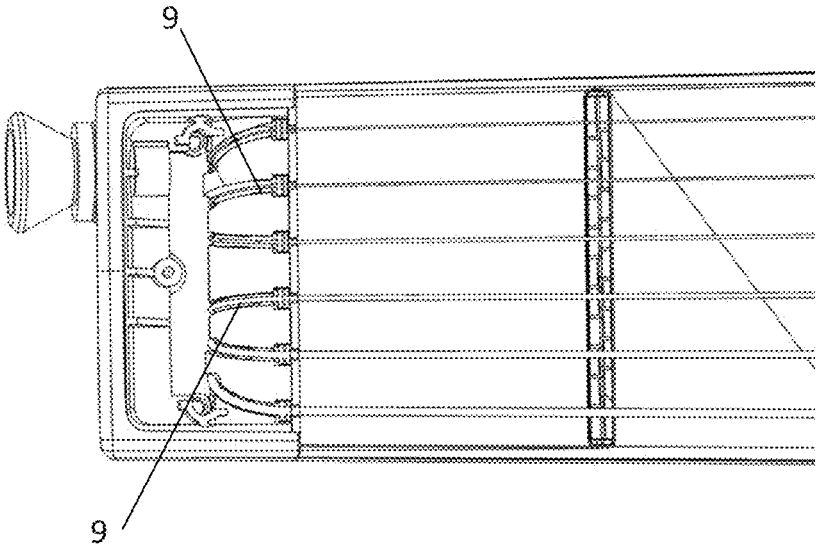
Figure 3:
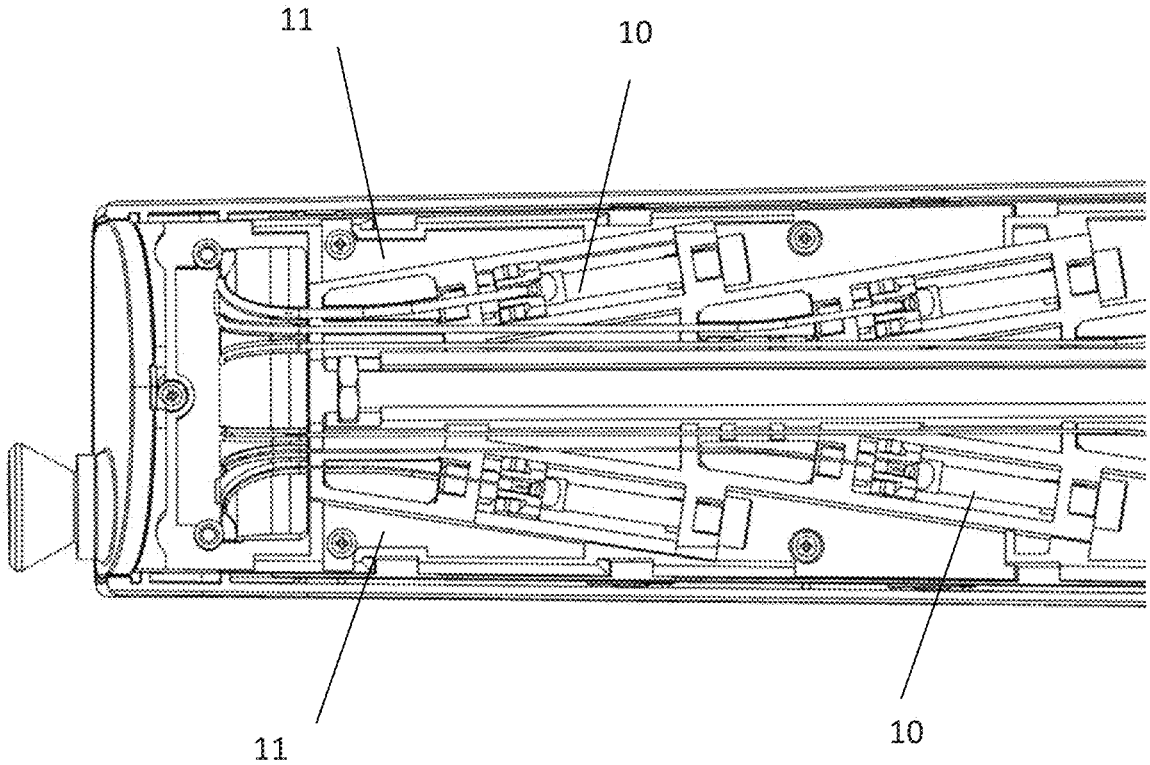
FIG. 3 is a general view of the screw mechanisms for tensioning the strings.
Figure 4A:
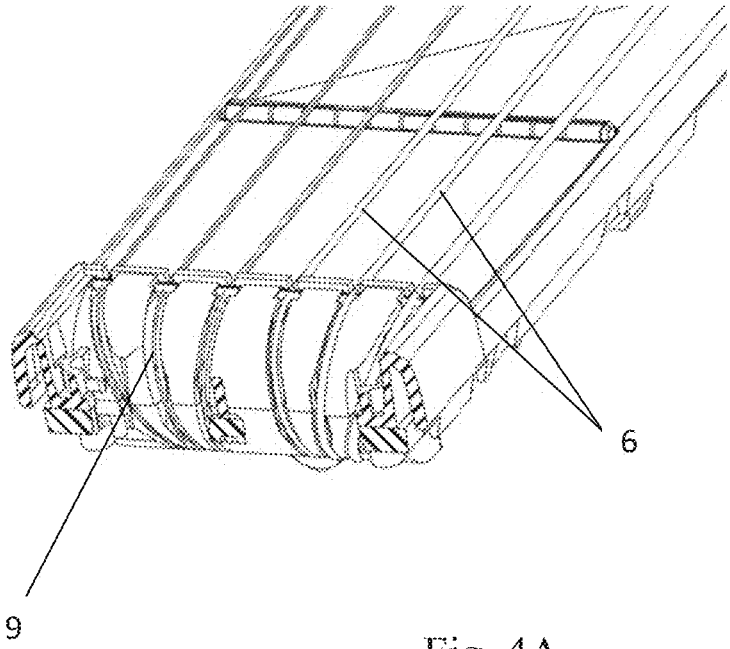
FIGS. 4A and 4B are fragments of a portion of the neck with the arrangement for directing the strings.
Figure 4B:
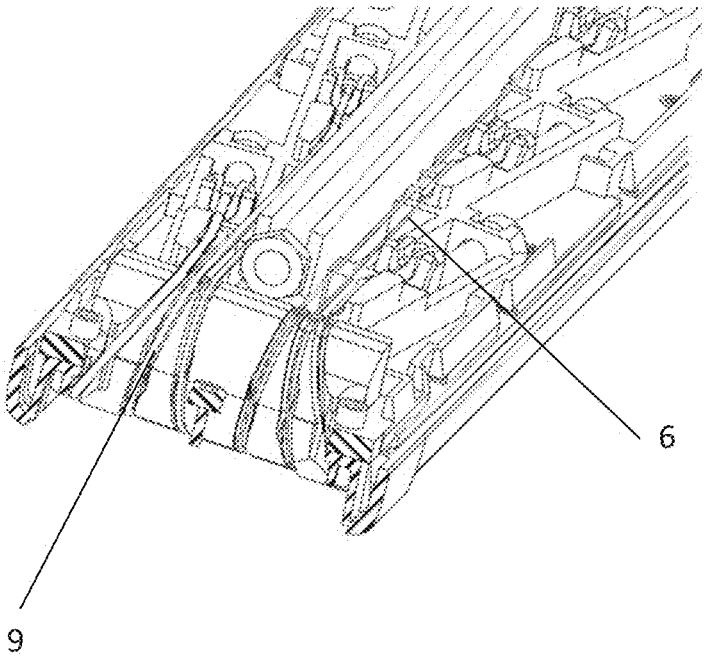
Figure 5:
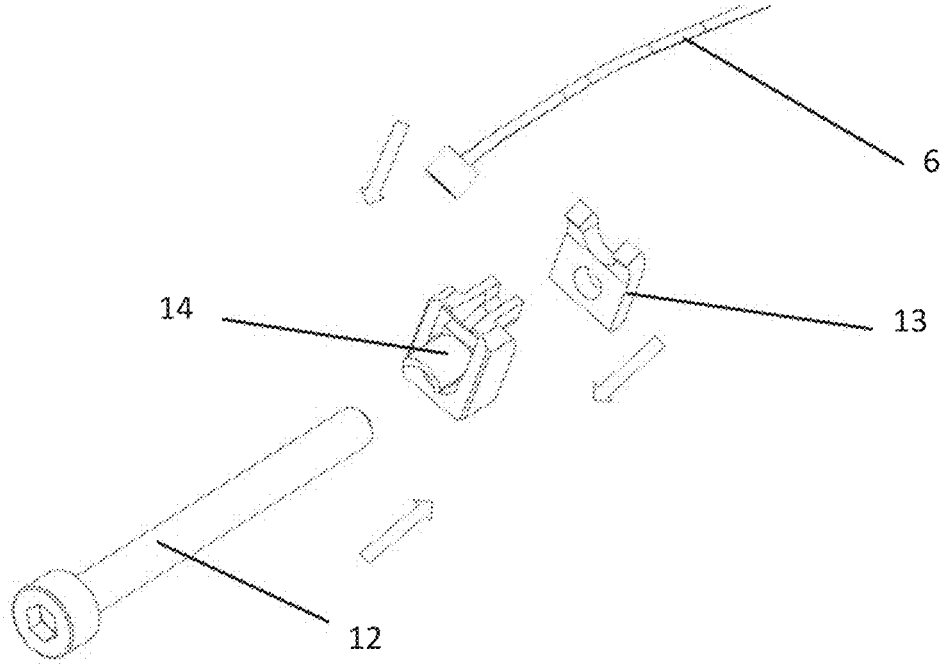
FIG. 5 illustrates constituent portions of the screw mechanism for tensioning the strings.
Figure 6:
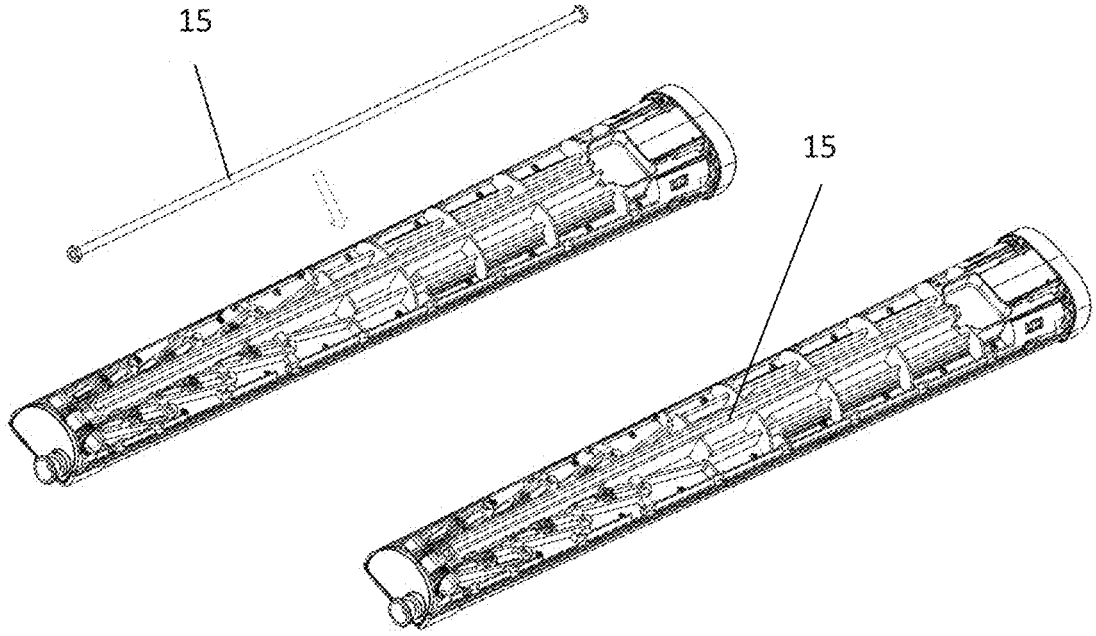
FIG. 6 is a general view of the neck with the system for fixing and tensioning the strings with the reinforcement member (the truss rod).
Figure 7:
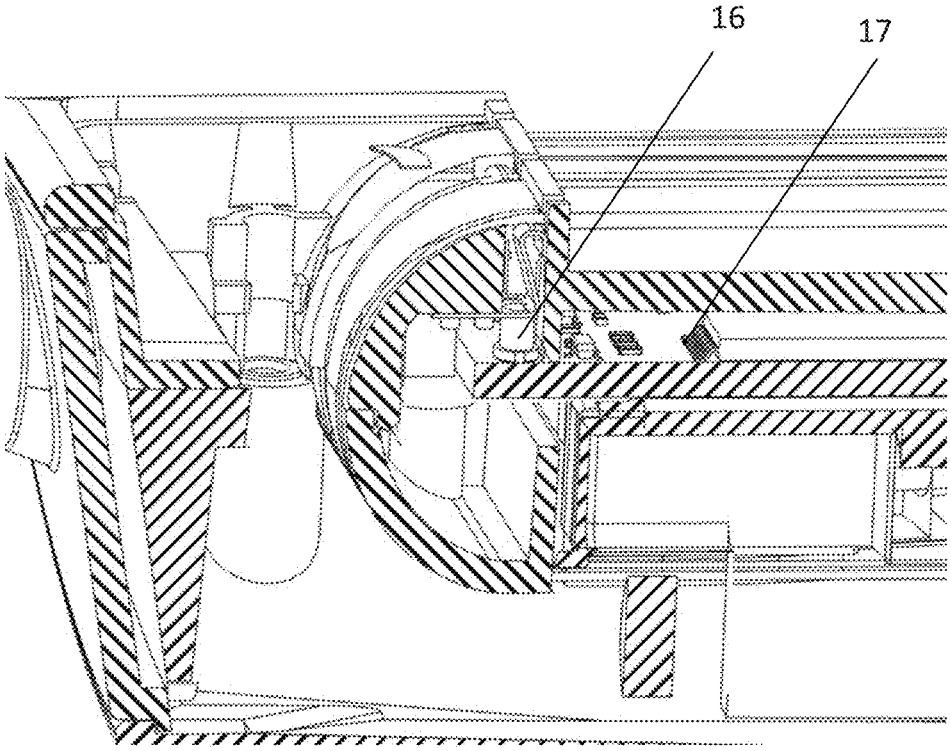
FIG. 7 is a section of the fragment of the neck with the system for fixing and tensioning the strings.

Figure drawings that illustrate the invention claimed as well as particular embodiments are merely exemplary in nature and are in no way intended to limit the claims appended hereto but to assist in explaining the invention.

DETAILED DESCRIPTION OF THE INVENTION (INFORMATION CONFIRMING THE POSSIBILITY OF EMBODIMENT)

A system for fixing and tensioning strings of a musical instrument is arranged on a neck 1. Nuts 2 with frets 3 located therebetween are arranged on a front portion of the neck 1. A string holder 4 is arranged at one of the ends of the neck 1, with the system for fixing and tensioning strings being arranged on the second end and on the rear side. The system and the neck 1 are preferably arranged under a protective cover 5. The strings 6 are tensioned over the nuts 2 and frets 3. The system for fixing and tensioning strings consists of an arrangement 7 for directing the strings arranged behind an upper nut 8 on a face surface of the neck 1. The arrangement 7 for directing the strings is designed as a curved plate, which has guides 9 for the strings 6 provided therein in the form of recesses. Fixing and tensioning of the strings 6 is made by means of adjusting screw mechanisms 10 arranged at an acute angle to the longitudinal axis of the neck on a metal frame 11. The strings 6 pass along the guides of the arrangement 7 for directing the strings, wherein one of the ends of each string is provided with a tip having a width that exceeds a width of the cavity of the collar that provides fixing of the string 6 to the adjusting screw mechanism 10. Each adjusting screw mechanism 10 comprises a tension screw 12 having an arrangement for fixing the strings in the form of a female screw that is immovably mounted in the metal frame, the female screw having a slot provided in an upper portion thereof, and a collar 13, which upper portion is provided with a cavity for placing the string 6 that is coupled to the slot of the female screw. The collar is equipped, in the location of the end of the string, with a member 14 that separates it from the screw, and the member is made of an electrically insulating material. A reinforcement member preferably, (a truss rod) 15 is mounted along the entire length of the neck. In case of using this system for fixing and tensioning strings for electrical instruments, electronic components of the system, e.g., electrical contacts 16 coupled to an electrical board 17, may be arranged in the middle of the neck housing.

The operation principle of the system for fixing and tensioning strings of a stringed musical instrument will next be described.

Fixing and tensioning of the strings 6 is accomplished as follows: one end of each string 6 is extended into the string holder 4. Second ends of the strings 6, which are provided with the tips for fixing, are extended through the arrangement 7 for directing the strings that is shaped as a curved plate, wherein the strings 6 are placed on the guides 9, which separate them from each other. The strings 6 are brought through the guides 9 to the back side of the neck and fixed on the adjusting screw mechanism 10. Fixation of the strings to the screw mechanism is performed by fixation of the tips of the strings in the cavity of the collar. Tensioning and tuning of the strings 6 is performed by tension screws 12.

A set of features, namely: arranging the arrangement for directing the strings on the face surface of the neck, arranging the adjusting screw mechanism for tensioning and tuning the strings on the back side of the neck, providing the strings with the tips for fixing and arranging the electronic components in the middle of the neck reduce its overall size and shorten the time for tensioning and tuning the strings. Providing the face and back surfaces of the neck with the cover avoids its contamination and brings a more aesthetically pleasing view to the neck. By making the frame of the system of a material, durable preferably metal, reliability thereof is increased and service life of the system is increased. Presence of the truss rod provides additional rigidity and avoids deformation of the neck.

The invention claimed is:

1. A system for fixing and tensioning strings of a stringed musical instrument, the system comprising a string holder provided on one end of a neck, an upper nut provided on a second end of the neck and adjusting screw mechanisms in a number that corresponds to the number of strings, each of the strings being configured so that a first end of the string can be fixed in the string holder, and a second end of the string can be passed through a groove of the upper nut and fixed on the adjusting screw mechanism, wherein an arrangement for directing the strings is mounted after the upper nut on a face surface of the neck, the arrangement being made in a form of a curved plate, which has respective guides for the strings provided therein; wherein the adjusting screw mechanisms are arranged at an acute angle relative to the longitudinal axis of the neck in a direction that is opposite to a direction of directing the strings from the side of the curved plate and are arranged in a frame fixed on a back surface of the neck; wherein a neck reinforcement member is mounted in a central portion of the neck longitudinally along the length of the neck, each screw mechanism being a tension screw having an arrangement for fixing the strings in the form of a female screw that is immovably mounted in the metal frame, the female screw having a slot provided in an upper portion thereof, and a collar, which upper portion is provided with a cavity for placing the string that is coupled to the slot of the female screw, the collar is equipped, in the location of the second end of the string, with a member that separates it from the screw, while the second end of each string is equipped with a tip having a width that exceeds a width of the cavity of the collar.

2. The system according to claim 1, wherein the frame is provided with respective mounting seat for each adjusting screw mechanism along the axis of the neck, the seats are arranged symmetrically successively opposite one another.

3. The system according to claim 1, wherein the frame is made of metal.

4. The system according to claim 1, wherein a truss rod is used as the neck reinforcement member.

5. The system according to claim 1, further comprising a cover on the face and/or back surfaces of the neck.

6. The system according to claim 1, further comprising electrical contacts coupled to a controller of an electrical board arranged inside the neck and mounted between the upper nut and the curved plate from the inner side of the curved plate.

7. The system according to claim 6, wherein the curved plate and the collar member that separates the string from the screw are made of an electrically insulating material.

* * * * *